US006655831B1

(12) United States Patent
Ruffieux

(10) Patent No.: US 6,655,831 B1
(45) Date of Patent: Dec. 2, 2003

(54) CASE FOR AN INSTRUMENT OF SMALL VOLUME INCLUDING A MANUALLY REMOVABLE BACK COVER

(75) Inventor: Patrick Ruffieux, Le Landeron (CH)

(73) Assignee: Asulab S.A., Marin (CH)

( * ) Notice: Subject to any disclaimer, the term of this patent is extended or adjusted under 35 U.S.C. 154(b) by 160 days.

(21) Appl. No.: 09/699,384

(22) Filed: Oct. 31, 2000

(30) Foreign Application Priority Data

Nov. 4, 1999 (CH) ..... 2017/99

(51) Int. Cl.[7] ..... A44C 5/00; G04B 37/00
(52) U.S. Cl. ..... 368/281; 368/309
(58) Field of Search ..... 368/276, 281, 368/284, 291, 292, 297–300, 309

(56) References Cited

U.S. PATENT DOCUMENTS 4,298,973 A 11/1981 Saito

FOREIGN PATENT DOCUMENTS

| | | |
|---|---|---|
| CH | 258894 | 5/1949 |
| CH | 632375 | 10/1982 |
| JP | 53-25462 | * 9/1978 |

* cited by examiner

*Primary Examiner*—Vit Miska
(74) *Attorney, Agent, or Firm*—Sughrue Mion, PLLC

(57) ABSTRACT

The watch case includes a middle part (2) and a removable back cover (3). The back cover (3) is held under the middle part by means of at least one rail (5), this rail having a first portion (7) arranged to be slid into a groove (9) made in the middle part (2) and a second portion (11) arranged to cap an edge (13) of the back cover (3). Without using tools, the user can remove the rail, take off the back cover and change the battery or batteries powering the movement.

7 Claims, 8 Drawing Sheets

CASE FOR AN INSTRUMENT OF SMALL VOLUME INCLUDING A MANUALLY REMOVABLE BACK COVER

BACKGROUND OF THE INVENTION

The present invention relates to a case for an instrument of small volume, in particular a watch, including a middle part and a removable back cover applied under the middle part.

This type of case is commonly used to cover a wristwatch. The back cover may either be screwed on or snap fitted and may have a sealing gasket interposed between the back cover and the middle part. A back cover of this type can only be set in place or removed using special tools and these operations are generally reserved for a watchmaker, as is apparent in the two designs taken as an example hereinbelow.

Swiss Patent No. 251 447 shows a back cover snap fitted under a middle part. The case includes a middle part-bezel, a casing frame freely fitted in the middle part, a crystal the heel of which is clamped between the inner edge of the middle part-bezel and the casing frame, and a back cover. The back cover is fitted freely in the middle part and is pressed against a compressible sealing gasket lining the bottom face of the casing frame, by two levers each pivoting on an edge located on the inside each of the two opposite sides carrying the lugs of the middle part.

Swiss Patent No. 329 625 shows a back cover applied under a middle part by means of a screw system. This watch includes a crystal of which the edge bent towards the exterior is pressed against a gasket by a casing ring on which it rests. In order to hold the latter in the case, and so that it exerts a pressure against the edge, the back cover, whose contour is rectangular like the middle part, is fitted into the bottom opening of the latter and has, on its outer face, an annular housing, of which the outer wall is tangential to the sides of the opening and open at these tangent locations. In this housing there is arranged an externally threaded round ring, which is screwed into the middle part at the aforementioned tangent locations. Notches facilitate the screwing and unscrewing thereof.

In the design types briefly described above as in all the other designs known to date, if the watch is fitted with a battery in order to operate, the user will have no other choice than to give the watch to a person skilled in the art to change the battery once the battery reaches the end of its life.

It is true that in order to overcome this drawback, certain case back covers are fitted with a battery hatch which consists of a cap screwed on or fixed by a bayonet fitting in the back cover, the cap being provided with a screw slot which allows the user to open the hatch himself by means of a coin, as is implemented for example in the Swatch watch (registered trademark).

However, this solution would not be suitable for a battery, or other power source, with a large diameter as is found in pager watches or in watches fitted with a GPS system. It would also not be suitable for a particular watch including at least two batteries. For this type of instrument of small volume, it is thus necessary to find a solution which allows the entire back cover to be removed in order to have free access to the battery or batteries which have to be changed, such access having to remain simple to implement by the user, and without having to use any tools.

It will also be noted that in this type of instrument (pager or GPS for example) the power source has to be changed frequently, due to the high power consumption of the system. The battery change must thus be able to be effected quickly and by the user himself who will keep spare batteries on him.

SUMMARY OF THE INVENTION

In order to overcome this problem, the present invention proposes a back cover held under the middle part by means of at least one rail, this rail having a first longitudinal portion arranged to be slid into a groove made in the middle part and a second longitudinal portion arranged to cap an edge of the back cover when said first portion is introduced into said groove to fix said back cover under said middle part.

BRIEF DESCRIPTION OF THE DRAWINGS

The features and advantages of the present invention will appear from the following description, made with reference to the annexed drawings and giving, by way of explanatory but non limiting example, several advantageous embodiments of the invention, in such drawings.

DETAILED DESCRIPTION OF THE INVENTION

Figure 1:
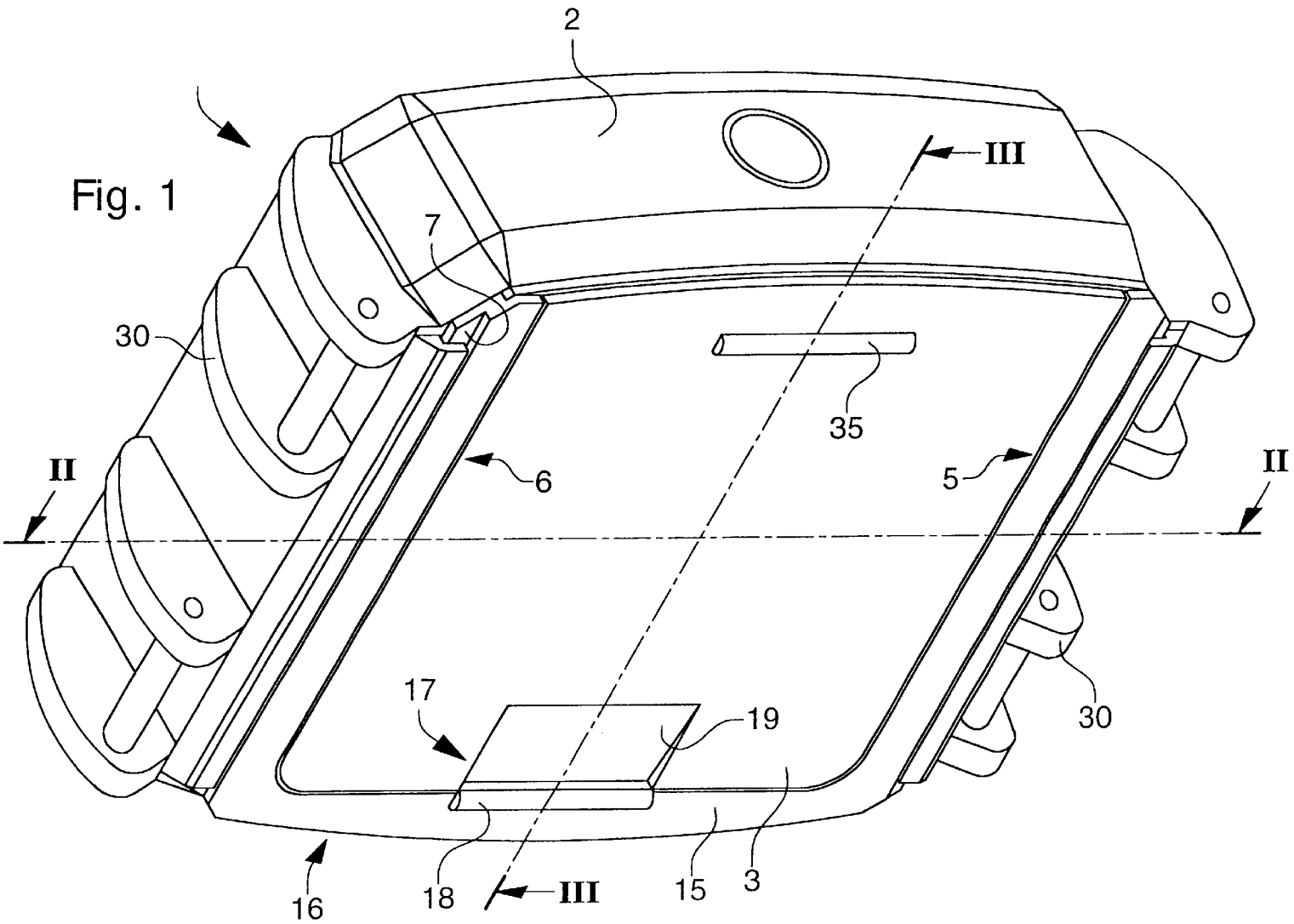
FIG. 1 is a perspective bottom view of the case according to the invention, and in its most evolved meaning.

The perspective view of FIG. 1 shows a watch case 1 according to the present invention and in its most evolved meaning. It shows a middle part 2 in which are integrated various horns 30 which will be used to secure the strands of a bracelet. Inside this middle part 2 are placed the watch movement and all the components which can accompany it, like for example, a pager or GPS electronic arrangement and a power source in the form of one or two batteries. A removable back cover 3 is applied under middle part 2. If necessary, a sealing gasket 4 (see FIGS. 2 and 3) is inserted between middle part 2 and back cover 3.

Figure 2:
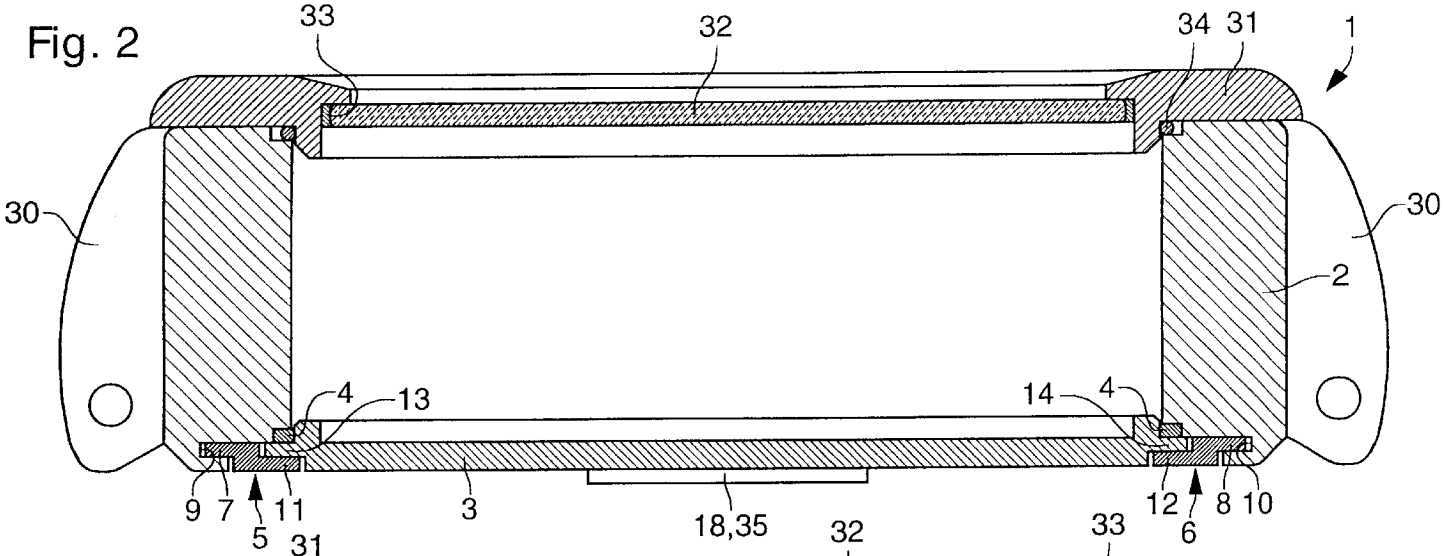
FIG. 2 is a cross-section of the case along the line II—II of FIG. 1.

As FIG. 1 shows, the case of the invention is characterised in that back cover 3 is held under middle part 2 by means of two rails 5 and 6 located on either side of back cover 3. As is visible in FIG. 2, which is a cross-section along the line II—II of FIG. 1, rail 5 has a first longitudinal portion 7 arranged to be slid into a housing or groove 9 made in middle part 2. Rail 5 also has a second longitudinal portion 11 arranged to cap an edge 13 of back cover 3 when said first portion 7 is introduced into said housing or groove 9. FIG. 2 also shows rail 6 constructed in a similar way to rail 5. Thus, rail 6 has a first longitudinal portion 8 arranged to be slid into a housing or groove 10 made in middle part 2. Rail 6 also has a second longitudinal portion 11 arranged to cap an edge 14 of back cover 3 when said first portion 8 is introduced into said housing or groove 10. It will thus be understood that when rails 5 and 6 are in place, back cover 3 is fixed under middle part 2.

Figure 3:
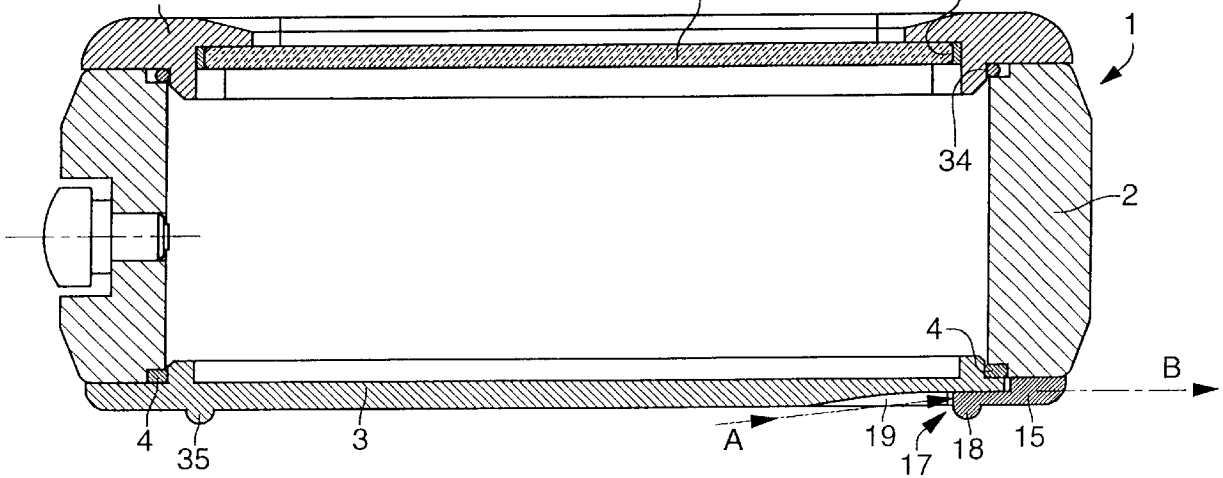
FIG. 3 is a cross-section in the case along the line III—III of FIG. 1.

In order to complete case 1 shown in FIGS. 2 and 3, middle part 2 carries on its upper portion a bezel 31 under which a crystal 32 is applied. The sealing between bezel 31 and crystal 32 is assured by a sealing gasket 33. The sealing between bezel 31 and middle part 2 is assured by a sealing gasket 34.

The invention could stop there and merely arrange two rails 5 and 6 to block back cover 3 under middle part 2. In this case, in order to remove back cover 3, the user slides rails 5 and 6 one after the other out of their respective housings, after which back cover 3 can be taken off. In order to facilitate this removal, each of the rails may be provided with a protruding portion at its end (not shown in the drawings). In order to close the case, back cover 3 is applied under middle part 2 and first of all first portion 7 of rail 5 is made to slide into its groove 9, second portion 11 of this rail then resting on edge 13 of back cover 3, then first portion 8 of rail 6 is made to slide into its groove 10, the second portion of this rail then resting on edge 14 of back cover 3. In the case which has just been explained, it will be noted that the rails are independent of each other and not necessarily parallel to each other.

It was however deemed useful and convenient to join the two rails 5 and 6 by a crosspiece 15 as shown in FIGS. 1, 3, 4 and 5. Crosspiece 15 forms with rails 5 and 6, arranged in parallel, a stirrup referenced 16 which is seen clearly in FIGS. 1 and 4. This stirrup 16 has the advantage of having on the one hand a single fastening part which is more difficult to lose and on the other hand, gripping means 17 for removing rails 5 and 6 simultaneously and manually from their respective housings 9 and 10 to thereby separate back cover 3 from middle part 2. An example of the gripping means will be described now.

Gripping means 17 are illustrated in FIGS. 1 and 3. Crosspiece 15 is provided with a bulge 18 and back cover 3 is provided with a hollow or slot 19 which faces bulge 18. In order to remove stirrup 16, one slides a fingernail into hollow 19 until the point of the fingernail rests on bulge 18. A force (arrow A) is exerted by the fingernail against bulge 18, which has the effect of releasing crosspiece 15 from middle part 2 (arrow B) and removing rails 5 and 6 from their housings.

Figure 4:
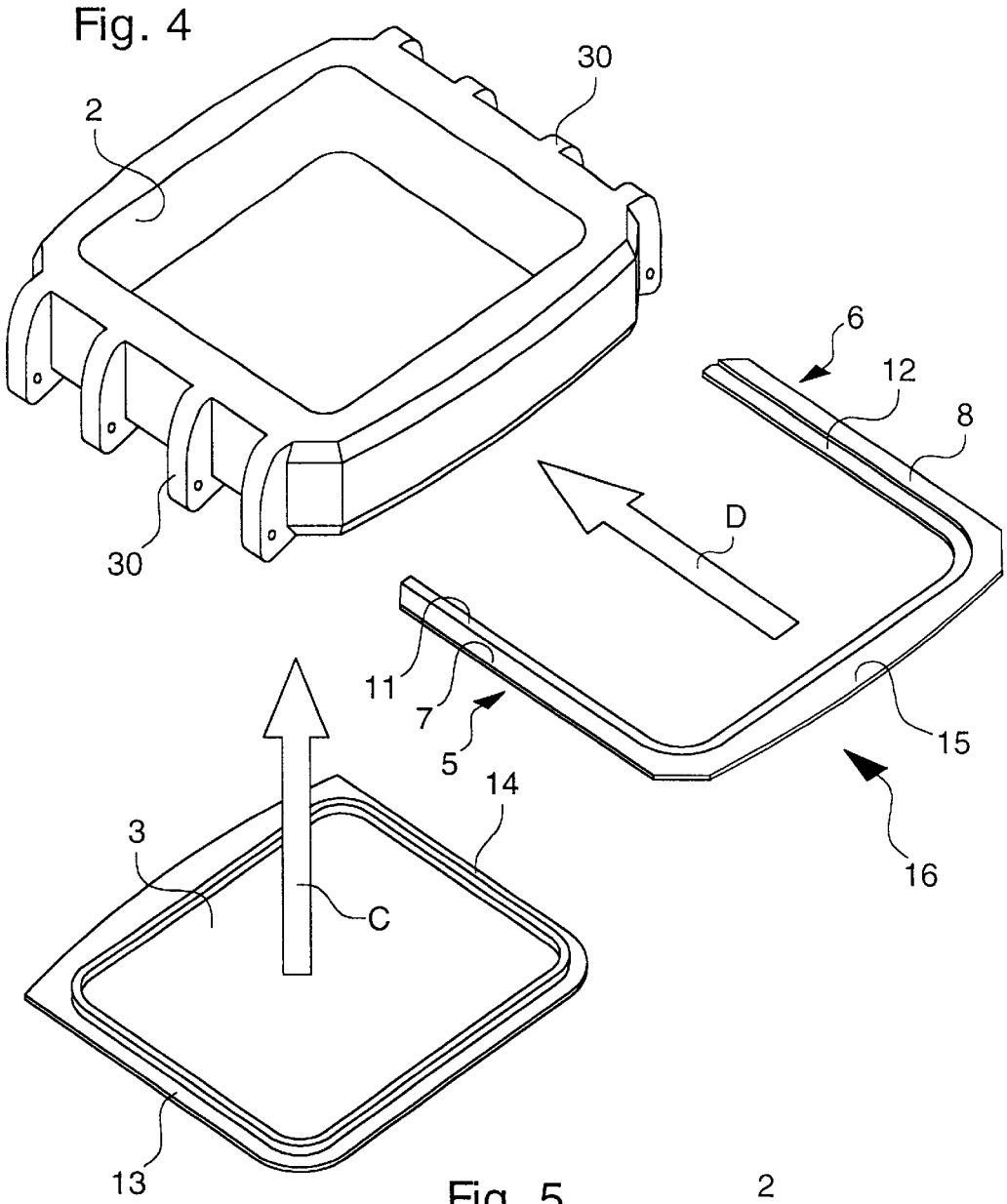
FIG. 4 is a blown up perspective view of the parts obturating the back of the middle part of the case according to the invention.

FIG. 4 illustrates the operations to be effected to close the case. One starts by applying back cover 3 under middle part 2 in the direction of arrow C. A certain force is maintained on back cover 3 in order to squash sealing gasket 4 slightly while the end of rails 5 and 6 is being introduced into their housings and they are slid, in the direction of arrow D, to the bottom of their housings, by pressing on crosspiece 15.

In order to act as a counterpart to bulge 18 and thus to assure a certain symmetry for back cover 3, the back cover is fitted with a second bulge 35 (FIGS. 1 and 3).

Figure 5:
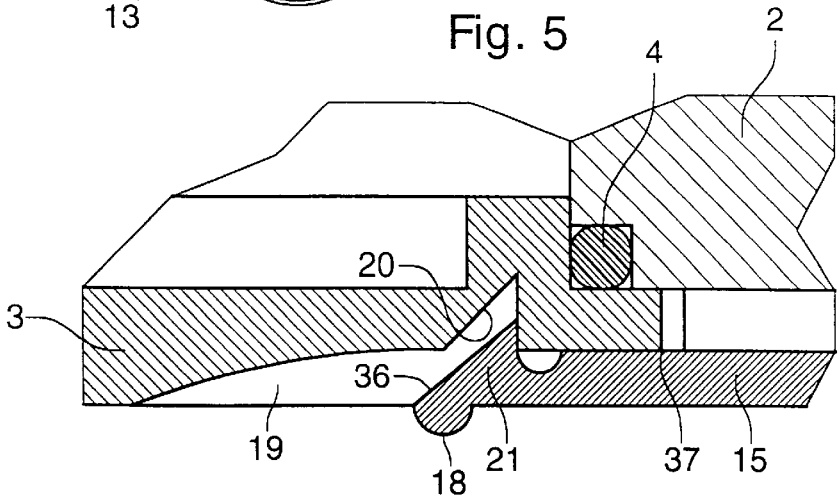
FIG. 5 shows a possible system for blocking the back cover of the case onto the middle part.

Once in place and as described hereinbefore, stirrup 16 is not protected from inadvertent removal due, for example, to an object appearing in front of the gripping means with which crosspiece 15 is provided. In order to avoid this, back cover 3 may be fitted with a notch 20 as shown in FIG. 5. This notch 20 is capable of accommodating a locking piece 21 arranged on crosspiece 15. This locking piece has, with respect to crosspiece 15, sufficient resilience to bend when it abuts, via its inclined plane 36, edge 37 of back cover 3 until its tip falls into notch 20. To release the locking piece, one need only act on plane 36 with a fingernail to make it bend and thereby release all of stirrup 16.

Figure 6:
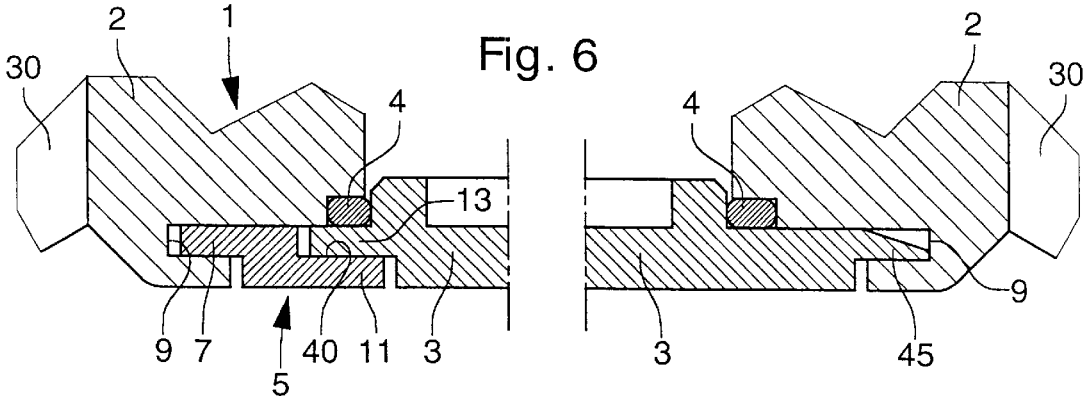
FIG. 6 is a partial cross-section of the case according to the invention in its simplest meaning.

The cross-section of FIG. 6 shows a watch case 1 according to the present invention and in its simplest meaning. Here, back cover 3 is held under middle part 2 by means of a single rail 5, which has, let us not forget, a first longitudinal portion 7 arranged to be slid into a groove 9 made in middle part 2 and a second longitudinal portion 11 arranged to cap an edge 13 of back cover 3. In this case, as appears in the right part of FIG. 6, the other edge 45 of back cover 3 ends in a point, arranged to be housed in a groove 9 arranged in middle part 2. In order to apply back cover 3 under middle part 2, one starts by introducing pointed edge 45 into groove 9 at a certain angle. Back cover 3 is then folded down under middle part 2 and back cover 3 is fixed by introducing rail 5.

Whether in the simplest meaning of the invention (FIG. 6) or in its most evolved meaning (FIG. 2), rails 5, 6 have a Z-shaped cross-section, first longitudinal portion 7 including a first rectangular heel which slides into groove 9 and second longitudinal portion 11 including a second rectangular heel whose top face 40 rests on edge 13 of back cover 3 (see FIG. 6).

Figure 7:
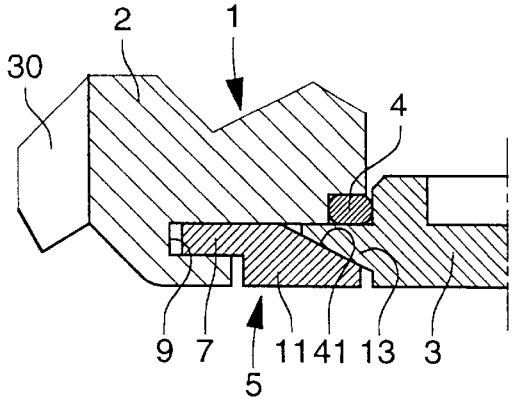
FIG. 7 is a partial cross-section showing a construction variant to that shown in FIG. 2.

The invention is not limited to this cross-section which may take other profiles such as for example, that shown in FIG. 7. Here, first longitudinal portion 7 of rail 5 includes a rectangular heel slid into groove 9 and second longitudinal portion 11 of rail 5 includes a corner having an inclined face 41 arranged to rest on an edge 13 of back cover 3, this edge being tapered.

In the following description, the elements which are identical to those previously described with reference to FIGS. 1 to 7 will be designated by the same numerical references. For a detailed description of these elements, reference will be made to the corresponding passages of the preceding description.

Figure 8:
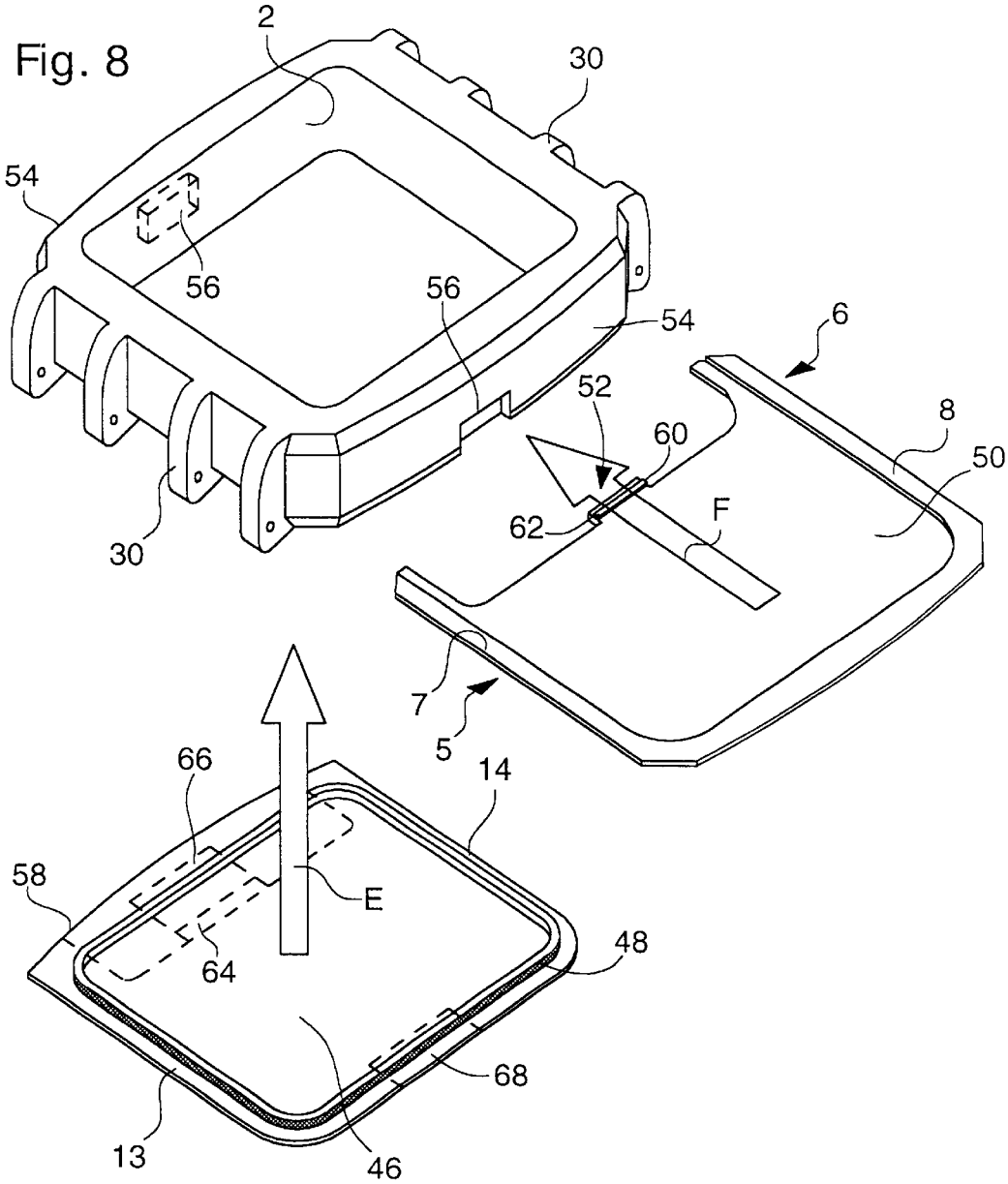
FIG. 8 is a perspective disassociated view of an alternative embodiment of the parts obturating the back of the middle part of the case according to the invention.
Figure 16:
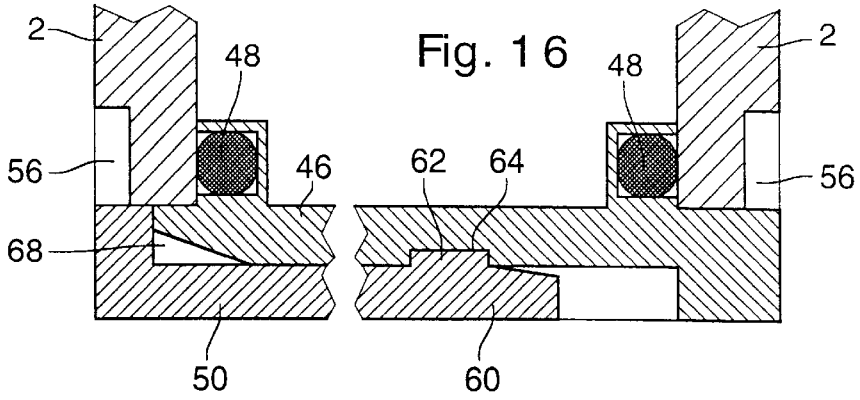
FIG. 16 is a cross-section in the assembly formed by the middle part of the watch and the parts obturating the back thereof.

The perspective view of FIG. 8 shows middle part 2 of watch case 1 which carries several horns 30 which serve to attach the strands of a bracelet. As for the variant illustrated in FIG. 4, the operations to be effected to close case 1 require first of all applying back cover 46 under middle part 2 in the direction of arrow E. A certain force is exerted on back cover 46 to squash a sealing gasket 48 and ensure that said back cover 46 is suitably applied under middle part 2. The end of rails 5 and 6 is then introduced into their respective housings 9 and 10 and they are slid, in the direction of arrow F, to the bottom of said housings 9 and 10.

According to the variant shown in FIG. 8, rails 5 and 6 are connected to each other by a holding plate 50 which, when rails 5 and 6 are slid into their housings 9 and 10, caps back cover 46 of case 1. More precisely, and as was described previously, rails 5 and 6 each have a longitudinal portion, respectively 7 and 8, arranged to be able to be slid into the housings or grooves 9 and 10 made in middle part 2. Thus, when rails 5 and 6 are in placed, back cover 46 is fixed under middle part 2, pressed against the latter by holding plate 50.

Holding plate 50 has multiple advantages. First of all it constitutes a single pieces which is less easy to lose. It also has gripping means 52 which will be described hereinafter to remove rails 5 and 6 from grooves 9 and 10. As it covers almost the whole of the surface of back cover 46, holding plate 50 protects the latter against scratches or other external attacks. Finally, with respect to stirrup 16 described hereinbefore, holding plate 50 gives the assembly which it forms with rails 5 and 6 an improved rigidity.

Figure 10:
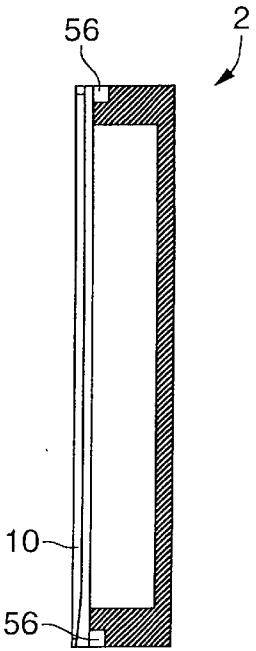
FIG. 10 is a cross-section along the line X—X of FIG. 9.
Figure 11:
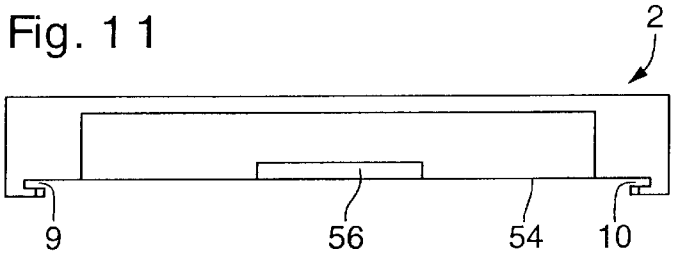
FIG. 11 is a cross-section along the line XI—XI of FIG. 9.
Figure 9:
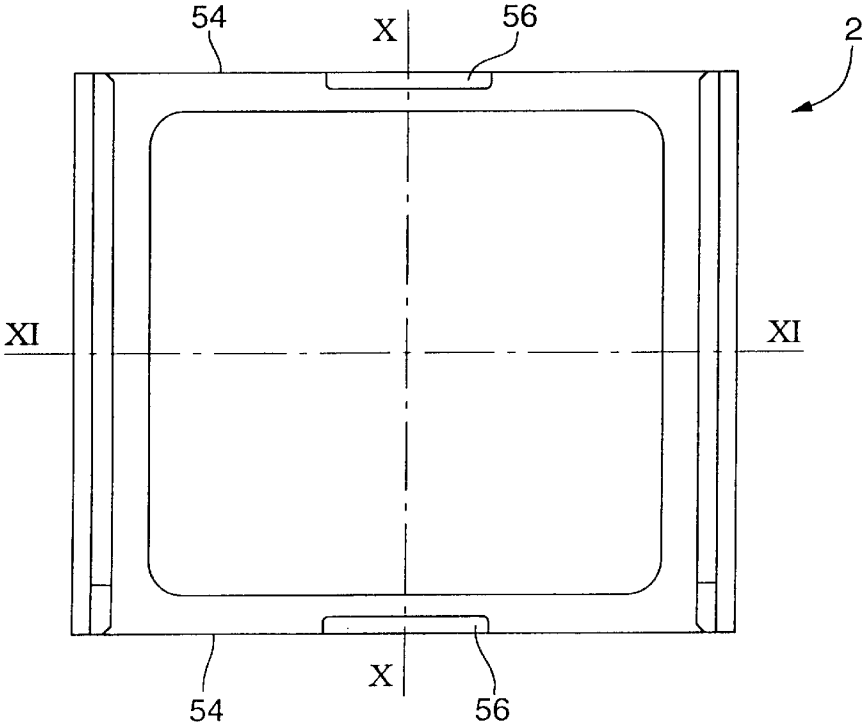
FIG. 9 is a simplified bottom view of the middle part.

In order to remove back cover 46, the user has to slide rails 5 and 6 out of their housings 9 and 10 made in middle part 2, after which back cover 46 can be taken off. In order to facilitate this operation, middle part 2 (shown schematically in FIGS. 9 to 11) has on its opposing transverse edges 54 two symmetrical grooves 56 which are open towards the bottom of case 1. When back cover 46 is fixed under middle part 2, it covers by its facing edge 58 one of the two grooves 56. The end of one of rails 5 and 6 need then only be slid into groove 56 covered by back cover 46 and to use this rail 5 or 6 like a lever arm to detach said back cover 46 from middle part 2. Of course, this example is given purely by way of illustration, and middle part 2 may only include a single groove 56 open towards the bottom to allow back cover 46 to be removed. Advantageously, holding plate 50 is capable of having a bulge which, in the closed position, obturates facing groove 56, which substantially improves the aesthetic appearance of the watch.

Figure 13:
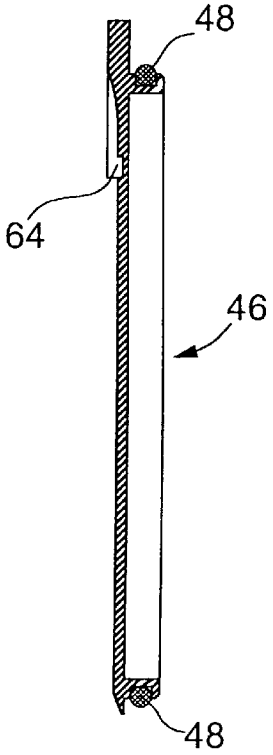
FIG. 13 is a cross-section along the line XIII—XIII of FIG. 12.
Figure 12:
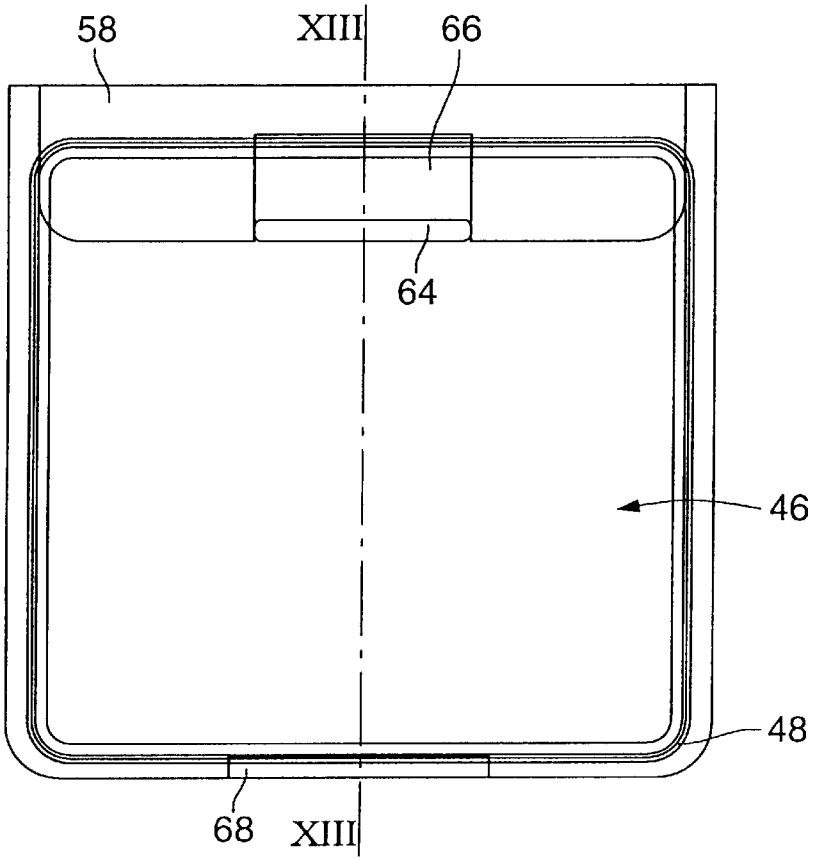
FIG. 12 is a bottom view of the back cover of the case.
Figure 15:
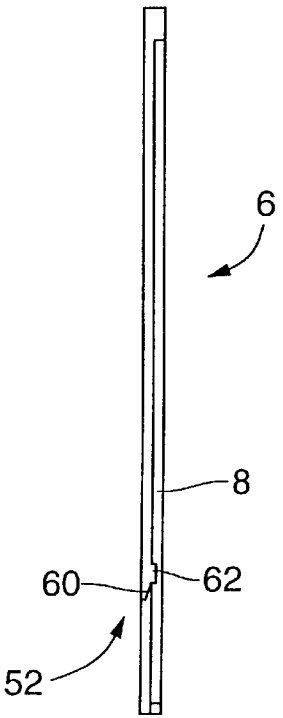
FIG. 15 is a cross-section along the line XV—XV of FIG. 14.
Figure 14:
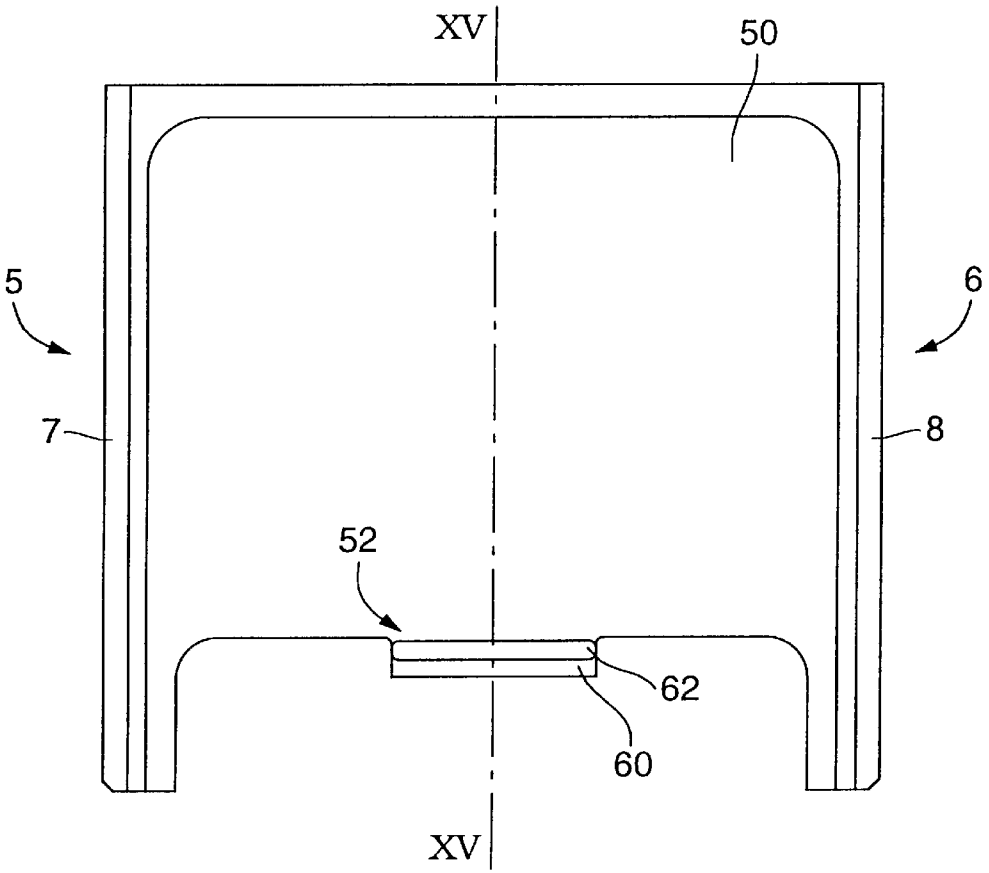
FIG. 14 is a top view of the plate for holding the back cover to the case.

Gripping means 52 are shown in FIGS. 12 and 13 relative to back cover 46 of watch case 1 and in FIGS. 14 and 15 which concern holding plate 50 of said back cover 46. Holding plate 50 has a tongue 60 on the top face of which is provided a bulge 62. When the two rails 5 and 6 are slid to the bottom of housings 9 and 10, bulge 62 is snap fitted into a groove 64 which faces said bulge 62 and which is provided on the outer surface of back cover 46.

To remove holding plate 50, the back cover has a hollow 66. The user then slides a fingernail into hollow 66 until the tip of the fingernail slightly raises tongue 60 of holding plate 50 and releases bulge 62 from groove 64. In the same movement, the user pushes back holding plate 50 which has the effect of removing rails 5 and 6 from their housings 9 and 10.

In order to facilitate the passage of bulge 62 of tongue 60 when rails 5 and 6 penetrate housings 9 and 10, back cover 46 includes a chamfer 68 which has an inclined face on which bulge 62 can slide.

The invention which has just been described shows that an instrument of small volume can be provided with a back cover which can be set in place or removed without the user using any tools. Thus, if a battery has to be changed frequently, the user does not need to request the assistance of a specialist.

What is claimed is:

1. A case for an instrument of small volume in particular a watch, including a middle part and a removable back cover applied under the middle part, wherein the back cover is held under the middle part by means of at least one rail, this rail having a first longitudinal portion arranged to be slid into a groove made in the middle part and a second longitudinal portion arranged to cap an edge of the back cover when said first portion is introduced into said groove to fix said back cover under said middle part;

wherein the back cover is held under the middle part by means of two rails located on either side of the back cover, these rails each having a first longitudinal portion arranged to slide into a respective groove made in the middle part and a second longitudinal portion arranged to cap a respective edge of the back cover;

wherein the two rails are arranged in parallel and are joined by a crosspiece to form a clamp; and wherein the back cover is provided with a notch able to accommodate a bolt arranged on the crosspiece to block the back cover under the middle part when the clamp is in place.

2. A case for an instrument of small volume in particular a watch, including a middle part and a removable back cover applied under the middle part, wherein the back cover is held under the middle part by means of at least one rail, this rail having a first longitudinal portion arranged to be slid into a groove made in the middle part and a second longitudinal portion arranged to cap an edge of the back cover when said first portion is introduced into said groove to fix said back cover under said middle part;

wherein the back cover is held under the middle part by means of two rails located on either side of the back cover, these rails each having a first longitudinal portion arranged to slide into a respective groove made in the middle part and a second longitudinal portion arranged to cap a respective edge of the back cover;

wherein the two rails are arranged parallel to each other and are joined by a holding plate which, when the rails are slid into their respective housings, caps the back cover of the case.

3. A case according to claim 2, wherein the holding plate has gripping means for manually removing the rails from their respective housings thereby separating the back cover from the middle part.

4. A case according to claim 3, wherein the holding plate includes a tongue provided with a flange and in that the back cover is provided with a groove able to accommodate the flange.

5. A case according to claim 4, wherein the back cover is provided with a hollow facing the tongue to allow the holding plate to be removed by means of a fingernail.

6. A case according to claim 4, wherein in order to facilitate the passage of the flange when the rails penetrate their respective housings, the back cover includes a chamfer which has an inclined face on which the flange can slide.

7. A case according to claim 5, wherein in order to facilitate the passage of the flange when the rails penetrate their respective housings, the back cover includes a chamfer which has an inclined face on which the flange can slide.

* * * * *